US005442829A

United States Patent [19]

Summers

[11] Patent Number: 5,442,829

[45] Date of Patent: Aug. 22, 1995

[54] PERSONAL HAND AND NAIL BRUSH

[76] Inventor: Andre D. Summers, 6 Masconemet Ave., Norfolk, Mass. 02056

[21] Appl. No.: 314,957

[22] Filed: Sep. 29, 1994

[51] Int. Cl.[6] ..... A46B 5/02; A45D 29/17

[52] U.S. Cl. ..... 15/106; 15/143.1; 15/167.3; 15/DIG. 5; 15/160

[58] Field of Search .... 15/106, 160, 161, 167.1–167.3, 15/143.1, DIG. 5, DIG. 6; D4/119, 130

[56] References Cited

U.S. PATENT DOCUMENTS

| | | | |
|---|---|---|---|
| 183,758 | 10/1876 | Furter | 15/160 |
| 378,784 | 2/1888 | Foster et al. | 15/106 |
| 416,330 | 12/1889 | Foster | 15/160 |
| 430,077 | 6/1890 | Jenness | 15/160 |
| 608,365 | 8/1898 | Goehring | 15/160 |
| 1,059,426 | 4/1913 | Barnes | 15/167.1 |
| 1,398,864 | 11/1921 | Kelly | 15/143.1 |
| 1,409,830 | 3/1922 | Chicken | 15/167.1 |
| 1,452,108 | 4/1923 | Carter | 15/167.1 |
| 1,804,415 | 5/1931 | Hales | 15/143.1 |
| 1,805,587 | 5/1931 | Manley | 15/167.1 |
| 1,812,626 | 6/1931 | Edison | 15/167.1 |
| 2,190,277 | 2/1940 | Viragh | 15/160 |
| 2,464,321 | 3/1949 | Konczal | 15/143.1 |
| 3,281,881 | 11/1966 | Yetter | 15/104.92 |
| 3,843,991 | 10/1974 | Vallis | 15/167.3 |
| 4,479,277 | 10/1984 | Gilman et al. | 15/167.3 |
| 4,480,351 | 11/1984 | Koffler | 15/187 |
| 4,617,917 | 10/1986 | Miller | 15/161 |
| 4,757,571 | 7/1988 | Young | 15/167.3 |
| 4,866,806 | 9/1989 | Bedford | 15/104.94 |
| 5,072,481 | 12/1991 | Weyer | 15/DIG. 5 |
| 5,230,117 | 7/1993 | Johnson et al. | 15/DIG. 6 |
| 5,312,197 | 5/1994 | Abramson | 401/6 |
| 5,351,358 | 10/1994 | Larrimore | 15/167.2 |

FOREIGN PATENT DOCUMENTS

| | | | |
|---|---|---|---|
| 199835 | 11/1986 | European Pat. Off. | 15/DIG. 5 |
| 618049 | 3/1927 | France | 15/167.2 |
| 1204669 | 8/1959 | France | 15/106 |
| 571223 | 2/1933 | Germany | 15/167.1 |
| 936385 | 12/1955 | Germany | 15/106 |
| 423547 | 5/1967 | Switzerland | 15/160 |
| 7173 | of 1904 | United Kingdom | 15/160 |
| 476186 | 12/1937 | United Kingdom | 15/106 |

*Primary Examiner*—Mark Spisich

*Attorney, Agent, or Firm*—Jacobson, Price, Holman & Stern

[57] ABSTRACT

A hand and nail brush used to clean both sides of a hand and having a curved, recessed brush area for the cleaning of fingers and fingernails. An elongated generally rectangular-shaped body has four finger recesses located extending along opposite side edges of the brush body. The finger recesses facilitate ease of use of the brush when the hands of the user are wet with soap. The surface of the brush body utilized to clean both sides of the hand has bristles of a length of approximately ½ inch designed to clean but not scratch the hand surfaces. The curved, recessed area at one end of the brush body is used to clean the fingers and fingernails. This recessed area includes bristles of a shorter and less resilient material of approximately ¼ inch length. The sides of the recessed area, with one side tapering to the portion of the brush body used to clean the hand surfaces, includes bristles at a length of approximately 7/16 inch to clean all sides of the fingers and nails at the same time.

12 Claims, 1 Drawing Sheet

PERSONAL HAND AND NAIL BRUSH

FIELD OF THE INVENTION

The present invention relates to a hand and nail brush used to clean both sides of the hand and includes a recessed brush area for the cleaning of individual fingers and fingernails.

BACKGROUND OF THE INVENTION

The hands of a human are the greatest transmitters of micro-organisms such as bacteria and viruses that contribute to the spread of contagious and/or infectious diseases. One of the best and easiest ways of maintaining one's health is to routinely and conscientiously wash one's hands.

Various attempts have been made to produce hand and/or finger scrub brushes. Examples of these brushes can be found in U.S. Pat. No. 4,480,351 to Koffler, U.S. Pat. No. 3,843,991 to Vallis, U.S. Pat. No. 5,312,197 to Abramson, U.S. Pat. No. 4,757,571 to Young, U.S. Pat. No. 4,866,806 to Bedford, and U.S. Pat. No. 4,479,277 to Gilman et al.

Each of these patents fails to appreciate that three different zones of a brush can be used for a complete cleansing of the hand, fingers, and fingernails.

SUMMARY OF THE INVENTION

Accordingly, it is an object of the present invention to provide three zones on a brush for cleaning of the hands, fingers, and fingernails of a person. The present invention includes a hand and nail brush used to clean both sides of a hand and having a curved, recessed brush area for the cleaning of fingers and fingernails.

By the present invention, an elongated generally rectangular-shaped body has four finger recesses located extending along opposite side edges of the brush body. The finger recesses facilitate ease of use of the brush when the hands of the user are wet with soap.

The surface of the brush body utilized to clean both sides of the hand has bristles of a length of approximately ½ inch designed to clean but not scratch the hand surfaces. The curved, recessed area at one end of the brush body is used to clean the fingers and fingernails. This recessed area includes bristles of a shorter and less resilient material of approximately ¼ inch length. The sides of the recessed area, with one side tapering to the portion of the brush body used to clean the hand surfaces, includes bristles at a length of approximately 7/16 inch to clean all sides of the fingers and nails at the same time.

The brush body is made of polyethylene material molded onto sets of bristles made of thermoplastic rubber or polyethylene or other contrasting stiffness bristle material.

The density of the bristles on the brush varies across the brush body dependent upon the function of a specific area of the brush body. For example, in the portion of the brush body used to clean the hand surfaces, in a ½ inch by ½ inch area of this portion of the brush body, there are twelve groups of approximately 115 bristles per group.

In the center of the curved recessed end of the brush body located at one end of the brush body, in the area used to clean the fingernails, there are in a ½ inch by ½ inch area, nine groups of approximately 90 bristles per group. On the opposite sides of the fingernail cleaning area, there are two areas on the brush body with bristles in a ½ inch by ½ inch area, in nine groups of approximately 90 bristles per group.

By varying the density of the bristles across the brush body, various functions can be achieved by the use of the brush body for its intended purpose. The location of the curved (or arcuate) recessed portion at one end of the brush body allows a firm grip of the brush body while facilitating clear visibility of the fingers and fingernails to be cleaned.

Accordingly, it is another object of the present invention to provide a brush body having at least three areas of different bristle length for cleaning both sides of the hand, the fingers, and fingernails.

It is yet another object of the present invention to provide a brush body having at least three areas of different bristle length for cleaning both sides of the hand, the fingers, and fingernails with the density of bristles in the various areas on the brush body being varied to accomplish the intended function.

It is still yet another object of the present invention to provide a brush body having at least three areas of different bristle length for cleaning both sides of the hand, the fingers, and fingernails with the density of bristles in the various areas on the brush body being varied to accomplish the intended function with the fingernail and finger cleaning portion of the brush body being located at one end of the brush body so that the remainder of the brush body can serve as a handle for gripping the brush body and accurately guiding the end of the brush body for thorough cleansing of the fingers and fingernails.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
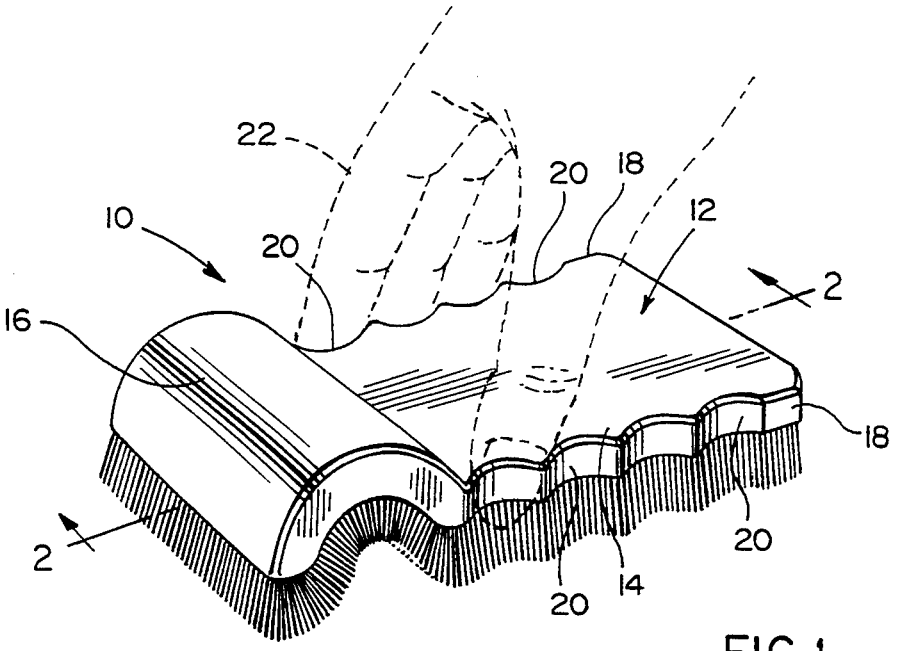
FIG. 1 is a perspective view of the present invention including a hand shown grabbing the brush body for illustrative purposes.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
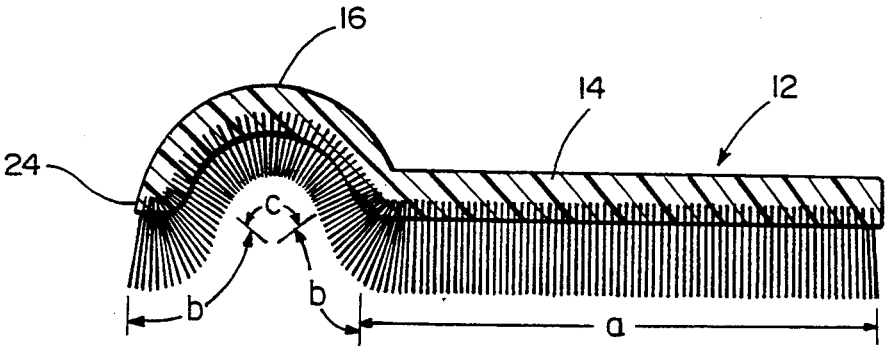
FIG. 2 is a cross-sectional view taken along line 2—2 of FIG. 1.

With reference to its drawings, in general, and to FIGS. 1 and 2, in particular, a personal hand and nail brush embodying the teachings of the subject invention is generally designated as 10. With reference to its orientation in FIG. 1, the personal hand and nail brush includes a brush body 12 of generally rectangular configuration having a substantially flat elongated portion 14 and an arcuate portion 16 located at one end of the brush body 12.

On opposed sides 18 of the flat portion 14 are four arcuate finger recesses 20. The recesses are for gripping the flat portion 14 of the brush body by a hand 22, as shown in phantom lines in FIG. 1.

In the position of the hand shown in FIG. 1, it is intended that the fingers and fingernails of the left hand of the user are to be cleaned by the user gripping the finger recesses 20 of the brush body with the right hand. The position of the brush body 12 with respect to the hand 22 shown in FIG. 1 would be reversed if the surfaces of the left hand of the user are to be cleaned so that the thumb of the right hand of the user grasps an opposite side and opposite end finger recess of the brush body as compared to what is shown. In an alternative embodiment, the four finger recesses at the opposite ends of both sides 18 of the brush body 12 are enlarged to accommodate .the thumb of the user as compared to the remaining finger recesses.

In looking at a sectional view of the brush body 12, the portion 14 includes bristles "a" of a length of approximately ½ inch. As shown in circle A in FIG. 3, these bristles have a density per ½ by ½ inch area of twelve groups of bristles with approximately 115 bristles per group.

Figure 3:
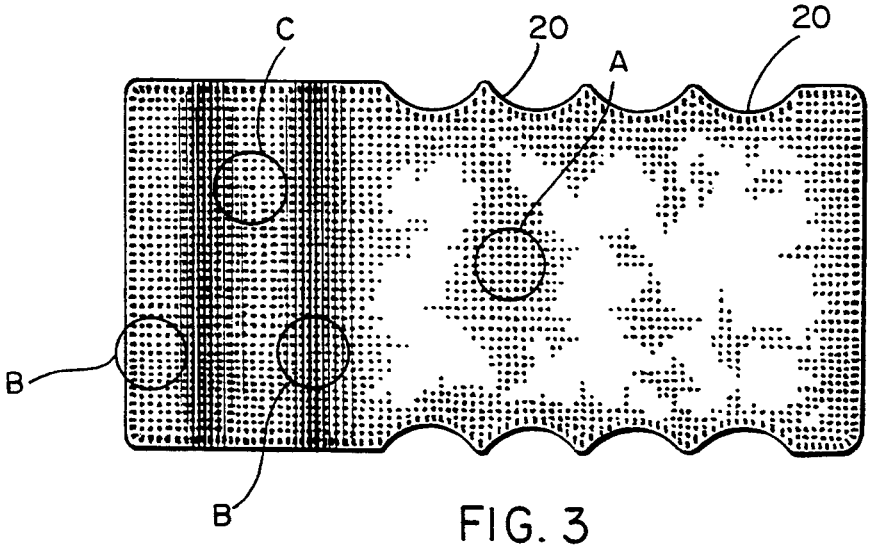
FIG. 3 is a bottom plan view of the brush body with encircled areas to denote areas of different density of bristles.

In the arcuate portion 16 of the brush body 12, the bristles "b" extending from the bristles "a" are of a length of approximately 7/16 inch and have a density as shown in circle B in FIG. 3 of nine groups of bristles per ½ inch by ½ inch area with 90 bristles per group. The bristles "b" are less resilient than the bristles "a" in section 14.

Extending adjacent to the bristles "b" which extend to the bristles "a" is a group of bristles "c" which are approximately ¼ inch in length. These bristles as shown in circle C have a density of nine groups per ½ inch by ½ inch area with approximately 90 bristles in each group. The bristles "c" are of a resiliency less than or equal to bristles "b".

On an opposite side of the bristles "c" proceeding towards an edge 24 of section 16, is another group of bristles "b" having a length of approximately 7/16 inch and a density as shown in corresponding circle B, of nine groups of bristles per ½ inch by ½ inch area with approximately 90 bristles per group. Both locations of bristles "b" have the same stiffness which is greater than the stiffness of bristles "a" and which is equal to or less than the stiffness of bristles "c".

By the semicircular curvature of the portion 16, and a correspondingly curved area defined by the two groups of bristles "b" and bristles "c" the fingers of the user are very thoroughly cleaned by engaging the bristles "b" and "c". In addition, due to the relative stiffness of the bristles "c" as compared to the bristles "a" the fingernails of the user are thoroughly cleaned as well.

Advantageously, the present invention is effective in reducing transmission of micro-organisms and thereby aiding in prevention in the spread of contagious or infectious diseases.

Having described the invention, many modifications thereto will become apparent to those skilled in the art to which it pertains without deviation from the spirit of the invention as defined by the scope of the appended claims.

I claim:

1. A brush comprising:

a body having a substantially flat, elongated portion including two ends and a recessed portion having two side edges, one of said two side edges of said recessed portion being continuous with one of said two ends of said substantially flat, elongated portion with the other of said two side edges of said recessed portion being free with a terminal surface of said other of said two side edges of said recessed portion being spaced from and in a same plane as said substantially flat, elongated portion so that said recessed portion defines an elongated channel extending along said one end of said substantially flat, elongated portion, said substantially flat, elongated portion and said recessed portion including bristles extending from one side of said body with said bristles of said substantially flat, elongated portion being a different length from a length of said bristles of said recessed portion.

2. A brush according to claim 1, wherein said bristles of said substantially flat, elongated portion are longer than at least some of said bristles of said recessed portion.

3. A brush according to claim 1, wherein said substantially flat, elongated portion includes finger recesses for holding said body.

4. A brush according to claim 1, wherein a density of said bristles per a unit area of said substantially flat, elongated portion is greater than a density of said bristles of said arcuate portion per said unit area.

5. A brush according to claim 4, wherein a rigidity of said bristles of said recessed portion is greater than a rigidity of said bristles of said substantially flat, elongated portion.

6. A brush according to claim 1, wherein a rigidity of said bristles of said recessed portion is greater than a rigidity of said bristles of said substantially flat, elongated portion.

7. A hand and nail brush comprising:

a body having a substantially flat, elongated portion including two ends for cleaning the hand of a user and a recessed portion having two side edges for cleaning the fingernails of the user, one of said two side edges of said recessed portion being continuous with one of said two ends of said substantially flat, elongated portion with the other of said two side edges of said recessed portion being free with a terminal surface of said other of said two side edges of said recessed portion being spaced from and in a same plane as said substantially flat, elongated portion so that said recessed portion defines an elongated channel extending along said one end of said substantially flat, elongated portion, bristles extending from said substantially flat, elongated portion, and bristles extending from said recessed portion, said bristles of said substantially flat, elongated portion being of a different length from a length of said bristles of said recessed portion and said bristles of said substantially flat, elongated portion and said recessed portion extending from one side of said body.

8. A brush according to claim 7, wherein said bristles of said substantially flat, elongated portion are longer than at least some of said bristles of said recessed portion.

9. A brush according to claim 7, wherein said substantially flat, elongated portion includes finger recesses for holding said body.

10. A brush according to claim 7, wherein a density of said bristles per a unit area of said substantially flat, elongated portion is greater than a density of said bristles of said arcuate portion per said unit area.

11. A brush according to claim 10, wherein a rigidity of said bristles of said recessed portion is greater than a rigidity of said bristles of said substantially flat, elongated portion.

12. A brush according to claim 7, wherein a rigidity of said bristles of said recessed portion is greater than a rigidity of said bristles of said substantially flat, elongated portion.

* * * * *